United States Patent [19]

O'Donnell

[11] 4,288,954

[45] Sep. 15, 1981

[54] SIMULATED LOG SIDING

[76] Inventor: Royce L. O'Donnell, 2721 E. Kelton La., Phoenix, Ariz. 85032

[21] Appl. No.: 81,650

[22] Filed: Oct. 4, 1979

[51] Int. Cl.[3] ..... E04B 1/10; E04C 2/26

[52] U.S. Cl. ..... 52/233; 52/313

[58] Field of Search ..... 52/233, 313, 316, DIG. 8; D25/85

[56] References Cited

U.S. PATENT DOCUMENTS

| | | | |
|---|---|---|---|
| 1,608,023 | 11/1926 | Hartmann | 52/313 |
| 1,758,046 | 5/1930 | Ilson | 52/313 X |
| 2,250,764 | 7/1941 | Hoess | 52/313 X |
| 2,787,029 | 4/1957 | Johnson | 52/233 |
| 2,829,404 | 4/1958 | Wilson | 52/313 X |
| 3,561,181 | 2/1971 | Bassett | 52/316 X |
| 3,815,308 | 6/1974 | Corey | 52/316 |

*Primary Examiner*—J. Karl Bell

*Attorney, Agent, or Firm*—Harry M. Weiss

[57] ABSTRACT

Wire metal lath is shaped to the generally semicircular configuration associated with a length of log used in a log wall structure. Several layers of cement-plaster are applied to the metal lath to waterproof it, and to lend texture and color to it. The effect of the layered and colored cement-plaster is to render the appearance of an actual log with its bark in place. A simulated log wall siding is made up of multiple lengths of such cement-plaster coated, simulated logs.

6 Claims, 3 Drawing Figures

SIMULATED LOG SIDING

BACKGROUND

1. Field of the Invention

The invention relates to siding used in the building trades.

More particularly, the invention relates to the field of building construction in which natural log siding is simulated.

Even more specifically the invention relates to the use of metal lath and cement plaster to simulate natural log siding.

2. Prior Art

The construction trades are an active field for innovation. Various techniques for siding a residence in a simplified manner, simulating the result of more complicated procedures, have been devised in recent years. Waterproof plywood sheets to simulate lap stake construction or clapboard siding are readily available in building supply stores. Concrete building blocks, so configured as to give the final structure the appearance of a shingled wall, are readily available.

In today's marketplace, it is almost impossible to build a log walled structure. Logs suitable for the task are generally not available. Where such logs are available, the price of them is generally prohibitive. A log walled structure is picturesque and offers some energy saving advantages due to the insulation characteristics of the wooden logs employed. However construction details are fairly complicated. Generally a planning or sawing operation is required to provide two generally diametrically opposed flat surfaces on each log to provide a stable bearing surface when the logs are mounted one on top of the other. The logs must be matched at the ends to provide for an interlocking corner arrangement. In general, it is advisable that the bark be removed from the log prior to construction. Failure to remove the bark initially will result in the later drying and stripping of the bark on the completed structure, lending a shabby appearance to the building until all of the bark has been removed in the course of the natural drying process or, as is more likely, as the results of the tenant to accelerate the process.

Logs for log wall construction are in scarce supply because of the general demand for wood products. Yet, people owning wooden lots or sections of alpine meadow frequently demand the charm of a log walled home or cabin. This continued demand for log walled structures has led to several innovative concepts. Where logs are still available, prefabricated structural elements are available to build anything from a simple log cabin to a multi-level home or resort structure. Where the demand for wood products and the availability of logs is such as to make it economically unfeasible to use entire logs for log walled structures, the central core of the log has been removed, making it available for particle board and the like, leaving the remaining cylinder for log wall construction. The resultant structure can be built for approximately 60–70% of the costs of building a conventional log walled structure. The dead air space provided by the removal of the log core provides energy conserving insulating characteristics to the air core log structure.

Not as aesthetically pleasing, but costing only approximately 15% of the cost of an equivalent true log wall structure, is the ship lap log siding. This siding is made of semi-rounded lumber somewhat close in size to the conventional 2×4 which is laid up on the building frame work ship lap fashion. The resultant simulation of a log wall structure is poor.

It is therefore an object of the present invention to provide a wall siding which will simulate a true log wall structure.

It is a further object of the invention to provide a simulated siding which will have the appearance of true log wall structure, but which will cost approximately 1/10 (one-tenth) that of a true log structure.

It is another object of the invention to provide a simulated log wall structure which is essentially maintenance free.

An additional object of the invention is to provide a simulated log wall structure whose insulation characteristics will enhance the energy saving capabilities of the structure with which the invention is used.

SUMMARY OF THE INVENTION

Wire metal lath is shaped to the generally semicircular configuration associated with a length of log used in a log wall structure. Several layers of cementplaster are applied to the metal lath to waterproof it, and to lend texture and color to it. The effect of the layered and colored cement-plaster is to render the appearance of an actual log with its bark in place. A simulated log wall siding is made up of multiple lengths of such cement-plaster coated, simulated logs. The spaces between the "logs" are provided with a coated of a light colored cement-plaster to simulate caulking between the logs. To finish the corners of the structure, end caps of metal lath, similarly coated and colored, are applied to simulate the effect of interlocked logs. All joints resulting from the addition of the end capped pieces are sealed with the cement-plaster mix. A cement sealer is then applied to the entire structure of simulated logs to prevent the weathering of the cement-plaster.

Two modes of practicing the invention are disclosed. In one, pre-formed metal lath is applied to the framed out structure, to the full height of the finished log wall siding. Metal lath end caps are now incorporated. The necessary waterproofing, color and texture plaster coatings are now applied in situ.

The second approach to the invention utilizes simulated log sections which have been pre-formed, coated, color coated and textured away from the work site. These pre-formed log simulations are provided in sizes that are reasonably easy to handle at the work site. Exposed metal lath flanges along the length of the pre-formed log simulations make it a relatively simple job to attach the pre-formed simulations to the existing formed structure. After assembly, the exposed metal lath flanges are coated with a light colored plaster to simulate caulking. Any resulting joints along log run lengths are hidden using cement plaster of matching color.

In applying the cement plaster coatings, knot holes and bough stems may also be simulated.

The resulting structure will closely resemble a true log wall sided building. An air space will be trapped behind each simulated wall adding to the insulating qualities of the structure.

DETAILED DESCRIPTION OF THE INVENTION

Figure 1:
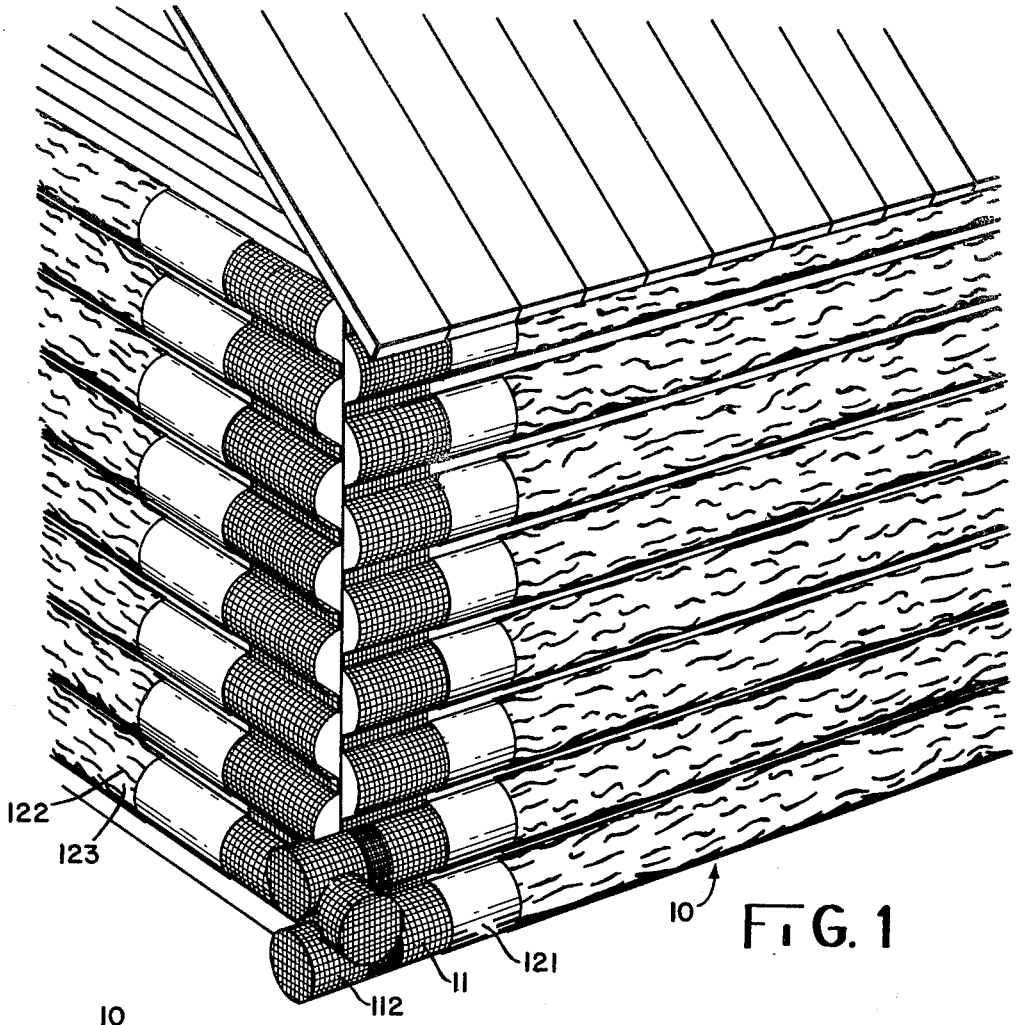
FIG. 1 is a partial perspective view of a structure using the simulated log wall siding of the invention. The drawing depicts the elementary components which make up the simulated log wall structure and, by peeling away the elementary layers of the structure, essentially teaches the method of fabricating the simulated log wall structure.

FIG. 1 illustrates the elements which combine to simulate a true log-wall structure. The natural log simulation is accomplished by applying a skeletal structure of a log wall to the existing frame work of a building. Coatings which are highly impermeable to water, are then applied to simulate the color and texture of natural logs. When the water impermeable coatings have set and cured, the overall appearance is of the building with natural log walls, which logs have characteristic bark color and display the shadowed interior of the bark interstices and the added appearance of a light colored caulking between the logs. The development of the simulated log wall may be carried on completely at the work site or sections of the simulated log covering, of convenient size and handling abilities, may be prefabricated at a facility removed from the work site.

Figure 2:
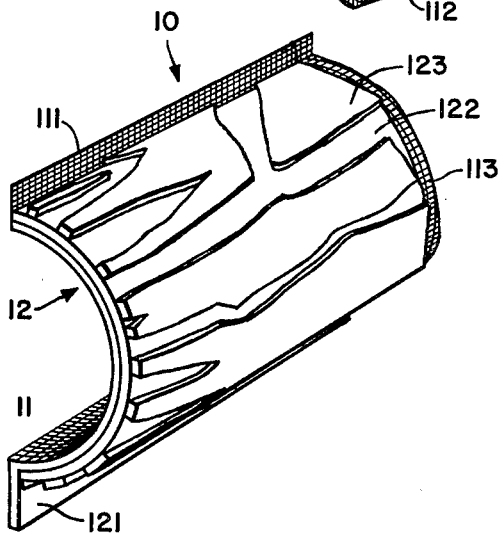
FIG. 2 illustrates in detail the construction characteristics of a simulated log indicating the underlying skeletal structure as well as the various water impermeable coatings which are applied to the skeletal structure to effect the simulation of the surface characteristics of a natural log.

As a study of FIG. 1 and FIG. 2 reveals, the simulated log 10 is comprised of a skeletal structure 11 which may be commercially available metal lath, the paper backed metal lath being preferred. The skeletal structure 11 is shaped so as to conform to the general appearance of the shape of a log as part of a log walled structure. Several water impermeable coatings 12 are then applied to skeletal structure 11 to provide an effect which simulates the color and texture of a natural log.

The first coating may comprise a waterproof cement plaster coat. A light color is suggested so as to later simulate the effect of caulking between the logs. Cement intended for swimming pools in the color known as "plastic white" quite effectively serves the purpose providing a light colored, waterproof coating over lath surface 11. It is suggested that coating 121 be allowed to fully cure before proceeding. A two to three week cure time is suggested as a minimum.

The second coat 122 is a dark coat meant to simulate the shadow interior of the bark interstices. Second coat 122 may be a stucco or plaster-cement mix having a dark coloring added to it. The addition of black cement coloring works quite effectively. This second coat 122 is applied to the entire surface of the log avoiding the space between the logs so as to leave light color coat 121 available to simulate the effect of caulking between the logs.

The third coat 123 is colored to simulate the natural color of wood bark. Commercially available brown and tan cement-coloring agents work well and may be combined in proportions as required to simulate the color of tree bark indigenous to the area in which the simulated log walled structure is constructed. This bark colored coating 123 is applied as an open coat to allow the dark color of coating 122 to show through so as to simulate the effect of bark and its dark interstices.

One skilled in the art will easily handle the application of bark coat 123 so as to apply the coating in a manner which simulates the texture of the bark of a natural tree. Indentations to simulate the knotty structure of a partially healed-over wound may be added as well as various protuberances to simulate the effect of bough stems of branches removed from the log.

Finally, to protect the structure from weathering, a block and concrete sealer is applied. Acrylic seals are commercially available for this purpose. The seal coat may be applied 8 to 12 hours after bark coat 123 has been completed. A second sealing coat is recommended approximately two weeks thereafter.

In practicing the invention, the skeletal structure 11, for example metal lath, may be formed at the work site and installed on a rough framed structure by fastening the lath to the frame along that portion of the lath 111 which is in contact with the structural framework. When the lath 11 is in place it will appear as indicated at the corner of the perspective view of FIG. 1.

When the adjacent walls have been covered with the lath, end caps 112 are fastened to the lath log structure as indicated in FIG. 1, to simulate the effect of interlocking logs.

Figure 3:
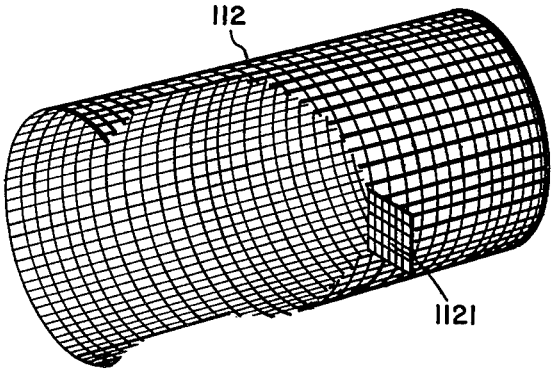
FIG. 3 illustrates a possible embodiment which may be assumed by a structural pre-form utilized to cap the ends of the simulated log structure so as to present the appearance, at the corners of the structure of an interlocked log arrangement.

End caps 112 may assume the configuration suggested in FIG. 3. Attachment flanges 1121 may be provided to implement the fastening of end caps 112 to metal lath forms 11.

When the skeletal structure 11 has been fastened to the rough frame work and end caps 112 fastened in place, the procedure outlined above for coating the lath so as to simulate a true log wall structure may begin. Waterproof coating 121 is applied to the entire lath structure including the spaces between the logs. By choosing a light colored waterproof coating, that coat between the logs may be left to lend the appearance of caulking between the final logs. After a suitable cure time of two to three weeks or more, the waterproof coat 121 is covered with a dark coat 122 to simulate the shadowed interior of the bark interstices. Immediately thereafter a third coat 123, colored to emulate the natural bark coloration of the logs being simulated, is applied over the dark coat 122 in an open fashion so as to permit the dark colored coating to show through so as to enhance the appearance of the wall as being one which is a true log structure.

A second approach to practicing the invention is suggested in FIG. 2. Here, a simulated log section 10 is prefabricated prior to installation on the rough framed structure. A portion of the skeletal structure such as lath flange 111 may be left uncoated to provide means whereby the prefabricated log may be assembled to the rough framework of the building. Lath extensions 113 may be provided at either end of the prefabricated log section to permit the mechanical coupling of one section of prefabricated log to another. After assembly to the rough frame structure, lath flange sections 111 would be coated with the light colored waterproof coating 121 to simulate the effect of caulking between the logs, while the voids in the surface coating which would be apparant where the lath extensions 113 of adjacent log sections are joined would then be provided with the necessary coating to render the juncture waterproof and to lend the necessary coloring and texture to simulate a continuous log as part of a log wall structure. In a similar fashion, end caps 112 could also be provided with much of the cement-plaster coating already in place. It is suggested that the prefabricated log structures and the necessary colored cement-plaster mixes be obtained from a common source so that the application of the plaster coat at the work site would blend with the plaster coatings applied to the prefabricated log structure.

What I have described is means and method for simulating a log wall structure. The simulated logs are highly impervious to water and provided with a sealing coat to further weatherize them. No maintenance thereafter will generally be required. Because the simulated log structure provides for a dead air space between the simulated log and the rough framing of the building to which the log structure is applied, the insulation characteristics of the building are enhanced. With natural logs it is usually necessary to first remove the bark before building a log wall structure. This is true because the bark tends to dry and peel away from the underlying log surface. However, with my invention, the beauty of the color and texture and three dimensional depth of a natural log with its bark intact, is preserved. Teachings herein disclosed may be practiced on a structure of a given size at the cost of approximately one-tenth that required to build a true log wall structure.

While the invention has been particularly shown and described with reference to the preferred embodiments thereof, it will be understood by those skilled in the art that the foregoing and other embodiments and details may be made without departing from the spirit and scope of the invention.

Having described my invention in such clear and concise terms in the specification and the drawings, that one skilled in the art may easily understand the invention and simply practice it, that which I claim is:

1. The method of simulating a log wall siding comprising the steps of:

forming a skeletal structure to the general configuration associated with lengths of log used in a log wall structure;

applying a first coating to said skeletal structure, said first coating having a light color serving to simulate caulking between logs;

applying a second coating over said first coating, avoiding the region between logs which is normally caulked, said second coating having a dark color serving to simulate the shadowed interior of the bark interstices of a natural log; and applying a third but open-coat over said second coating said third coating having a color serving to simulate the bark of a natural log, said open-coat application serving to allow said second coating to show through such that said second and third coating combine to simulate the effect of bark and its dark interstices.

2. The method of claim 1 comprising the further step of:

applying said skeletal structure to a building structure prior to applying said protective coatings.

3. The method of claim 1 comprising the further step of:

applying said skeletal structure to a building structure after applying said protective coatings to said skeletal structure.

4. The method of claim 1 including the further step of selecting said first coating to be a waterproof coating.

5. The method of claim 1 including the further step of selecting cement-plaster for at least one of said protective coatings.

6. The method of claim 1 including the further step of providing said skeletal structure with end caps simulating log ends.

* * * * *